US009341964B2

(12) United States Patent
Ogaki et al.

(10) Patent No.: US 9,341,964 B2
(45) Date of Patent: May 17, 2016

(54) PROCESS FOR PRODUCING ELECTROPHOTOGRAPHIC PHOTOSENSITIVE MEMBER

(71) Applicant: CANON KABUSHIKI KAISHA, Tokyo (JP)

(72) Inventors: Harunobu Ogaki, Suntou-gun (JP); Keiko Yamagishi, Kawasaki (JP); Atsushi Okuda, Yokohama (JP); Yohei Miyauchi, Tokyo (JP); Hiroki Uematsu, Mishima (JP); Kimihiro Yoshimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 54 days.

(21) Appl. No.: 14/359,272

(22) PCT Filed: Dec. 14, 2012

(86) PCT No.: PCT/JP2012/083165
§ 371 (c)(1),
(2) Date: May 19, 2014

(87) PCT Pub. No.: WO2013/094712
PCT Pub. Date: Jun. 27, 2013

(65) Prior Publication Data

US 2014/0342285 A1 Nov. 20, 2014

(30) Foreign Application Priority Data

Dec. 22, 2011 (JP) ..... 2011-282078
Dec. 11, 2012 (JP) ..... 2012-270604

(51) Int. Cl.
*G03G 5/00* (2006.01)
*G03G 5/06* (2006.01)
*G03G 5/047* (2006.01)
*G03G 5/05* (2006.01)

(52) U.S. Cl.
CPC ..... *G03G 5/0616* (2013.01); *G03G 5/047* (2013.01); *G03G 5/0514* (2013.01); *G03G 5/0525* (2013.01); *G03G 5/0614* (2013.01)

(58) Field of Classification Search
CPC . G03G 5/0616; G03G 5/0614; G03G 5/0514; G03G 5/047; G03G 5/0525; G03G 5/055; G03G 5/0564
USPC ..... 430/58.05, 58.4, 58.75, 58.85, 59.6, 96
See application file for complete search history.

(56) References Cited

U.S. PATENT DOCUMENTS

2009/0202274 A1 8/2009 Mitsumori et al.

FOREIGN PATENT DOCUMENTS

| | | | |
|---|---|---|---|
| JP | 2002-214811 | A | 7/2002 |
| JP | 2007-79555 | A | 3/2007 |
| JP | 2011-13355 | A | 1/2011 |
| JP | 2011-112863 | A | 6/2011 |
| JP | 2011-128213 | A | 6/2011 |

OTHER PUBLICATIONS

PCT International Search Report and Written Opinion of the International Searching Authority, International Application No. JP2012/083165, Mailing Date Jan. 29, 2013.
Okuda, et al., U.S. Appl. No. 14/353,463, filed Apr. 22, 2014.
Yamagishi, et al., U.S. Appl. No. 14/359,563, filed May 20, 2014.
Murakami, et al., U.S. Appl. No. 14/374,044, filed Jul. 23, 2014.
Murayama, et al., U.S. Appl. No. 14/378,288, filed Aug. 12, 2014.
European Search Report dated Aug. 6, 2015 in European Application No. 12859325.8.

*Primary Examiner* — Thorl Chea
(74) *Attorney, Agent, or Firm* — Fitzpatrick, Cella, Harper and Scinto

(57) ABSTRACT

In a process for producing an electrophotographic photosensitive member, in particular, a process of forming a charge transporting layer, a production process is provided by which the stability of a charge transporting layer coating fluid even after its storage for a long time is improved so as to form a coat for a charge transporting layer having a high uniformity. In a process for producing an electrophotographic photosensitive member having a charge transporting layer on a support, a production process is used in which a coat of (i) a liquid dispersion comprised of particles containing a charge transporting material, particles containing a binder resin, and an aqueous dispersion medium, or (ii) a liquid dispersion comprised of particles containing both a charge transporting material and a binder resin, and an aqueous dispersion medium, is formed on the support and then the coat is heated at a temperature not less than the melting point of the charge transporting material to form the charge transporting layer.

9 Claims, 1 Drawing Sheet

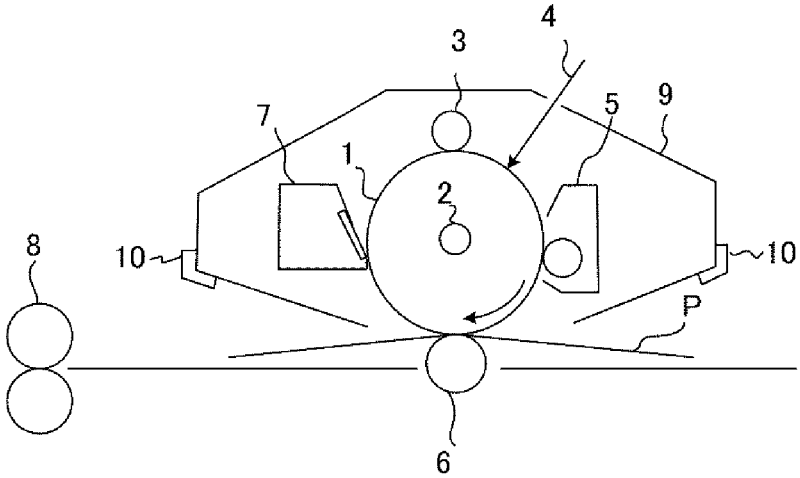
4
3
7
5
9
1
2
8
10
10
P
6

PROCESS FOR PRODUCING ELECTROPHOTOGRAPHIC PHOTOSENSITIVE MEMBER

TECHNICAL FIELD

This invention relates to a process for producing an electrophotographic photosensitive member.

BACKGROUND ART

As electrophotographic photosensitive members to be mounted to electrophotographic apparatus, development is energetically made on organic electrophotographic photosensitive members (hereinafter also "electrophotographic photosensitive member(s)") containing organic photoconductive materials. Also, at present, the organic electrophotographic photosensitive members are prevalent as electrophotographic photosensitive members used in electrophotographic process cartridges or electrophotographic apparatus, and are manufactured in a large scale. Of the organic electrophotographic photosensitive members, multi-layer type electrophotographic photosensitive members are in a large usage. In such multi-layer type electrophotographic photosensitive members, functions necessary for an electrophotographic photosensitive member are functionally separated into individual layers so as to be improved in characteristic features.

As a method for producing the multi-layer type electrophotographic photosensitive members, a method is commonly known in which functional materials are dissolved in organic solvents to prepare coating fluids, which are then multiply coated on a support. Of the individual layers of the multi-layer type electrophotographic photosensitive members, a charge transporting layer is required in many cases to have durability, and hence a coat therefor may have a larger layer thickness when compared with other layers. Hence, a coating fluid therefor is used in a large quantity, so that the layer formed may be one formed using an organic solvent in a large quantity.

In order to reduce the quantity of organic solvents to be used in producing electrophotographic photosensitive members, it is desirable to reduce the quantity of an organic solvent to be used in a charge transporting layer coating fluid. However, in order to prepare such a charge transporting layer coating fluid, a halogenous solvent or aromatic organic solvent must be used because charge transporting materials and binder resins have a high solubility in such solvents, and it has been difficult to reduce the quantity of organic solvents to be used.

PTL (Patent Literature) 1 reports an effort at aiming to reduce the quantity of organic solvents in coating materials for forming charge transporting layers, for the purpose of cutting down volatile substances or reducing carbon dioxide. This publication discloses that an organic solution prepared by dissolving in an organic solvent the substances to be contained in the charge transporting layer is formed into oil droplets in water to prepare an emulsion type coating fluid.

CITATION LIST

Patent Literature

PTL 1: Japanese Patent Application Laid-open No. 2011-128213

SUMMARY OF INVENTION

Technical Problem

However, in an electrophotographic photosensitive member production process in which the emulsion type coating fluid disclosed in PTL 1 is prepared, the emulsion type coating fluid is in the state of a uniform coating fluid immediately after it has been prepared, whereas, after the coating fluid has been left to stand for a long time, the emulsion type coating fluid has been seen to lower in solution properties. This is considered due to the fact that the substances to be contained in the charge transporting layer come to coalesce in water with time in the organic solution prepared by dissolving them in an organic solvent, to make it difficult to form a stable state of oil droplets, and have agglomerated or settled. It is sought to secure the stability of the charge transporting layer coating fluid and enhance the stability of manufacture.

Accordingly, an object of the present invention is to provide a process for producing an electrophotographic photosensitive member, which is an electrophotographic photosensitive member production process in which, especially in how to form a charge transporting layer, the stability of a charge transporting layer coating fluid after its storage for a long time is improved so as to form a coat for a charge transporting layer having a high uniformity.

Solution to Problem

The present invention is a process for producing an electrophotographic photosensitive member which comprises a support and a charge transporting layer formed on the support, comprising the steps of:

preparing the following liquid dispersion (i) or (ii);

(i) a liquid dispersion comprising particles containing a charge transporting material, particles containing a binder resin, and an aqueous dispersion medium; or (ii) a liquid dispersion comprising particles containing both a charge transporting material and a binder resin, and an aqueous dispersion medium;

forming a coat of the liquid dispersion (i) or (ii) on the support; and heating the coat at a temperature not less than the melting point of the charge transporting material to form the charge transporting layer;

the binder resin being soluble in a molten product of the charge transporting material at the temperature at which the coat is heated.

The present invention is also a process for producing an electrophotographic photosensitive member which comprises a support and a charge transporting layer formed on the support, comprising the steps of:

preparing the following liquid dispersion (i) or (ii);

(i) a liquid dispersion comprising particles containing a charge transporting material, particles containing a binder resin, and an aqueous dispersion medium; or (ii) a liquid dispersion comprising particles containing both a charge transporting material and a binder resin, and an aqueous dispersion medium;

forming a coat of the liquid dispersion (i) or (ii) on the support; and heating the coat at a temperature not less than the melting point of the charge transporting material to make the charge transporting material melt, and dissolving the binder resin in a molten product of the charge transporting material to form the charge transporting layer.

Advantageous Effects of Invention

As stated above, according to the present invention, in a process for producing an electrophotographic photosensitive member, an electrophotographic photosensitive member production process can be provided by which the stability of a charge transporting layer coating fluid even after its storage for a long time is improved so as to form a coat for a charge transporting layer having a high uniformity.

Further features of the present invention will become apparent from the following description of exemplary embodiments with reference to the attached drawings.

BRIEF DESCRIPTION OF DRAWINGS

FIG. 1 is a view showing schematically an example of the construction of an electrophotographic apparatus provided with a process cartridge having the electrophotographic photosensitive member of the present invention.

DESCRIPTION OF EMBODIMENTS

The process for producing an electrophotographic photosensitive member according to the present invention is an electrophotographic photosensitive member production process having the steps of forming on a support a coat of a liquid dispersion comprised of an aqueous dispersion medium, particles containing a charge transporting material and particles containing a binder resin, and heating the coat at a temperature not less than the melting point of the charge transporting material to form a charge transporting layer; the binder resin being soluble in a molten product of the charge transporting material.

The process for producing an electrophotographic photosensitive member according to the present invention is also an electrophotographic photosensitive member production process having the steps of forming on a support a coat of a liquid dispersion comprised of an aqueous dispersion medium and particles containing both a charge transporting material and a binder resin, and heating the coat at a temperature not less than the melting point of the charge transporting material to form a charge transporting layer; the binder resin being soluble in a molten product of the charge transporting material.

The production process of the present invention and materials constituting the electrophotographic photosensitive member are described below in detail.

The particles containing a charge transporting material and the particles containing a binder resin are described first. The particles containing both a charge transporting material and a binder resin are also described.

The charge transporting material is a material having hole-transporting ability, and may include materials as exemplified by a triarylamine compound and a hydrazone compound. In particular, the triarylamine compound may be used as the charge transporting material, and this is preferable in view of an improvement in electrophotographic performance. In the charge transporting material, a charge transporting material having the lowest melting point among a plurality of charge transporting materials to be contained in the charge transporting layer may preferably have a melting point of 160° C. or less.

Specific examples of the charge transporting material are shown below, but not limited to these.

(1-1)

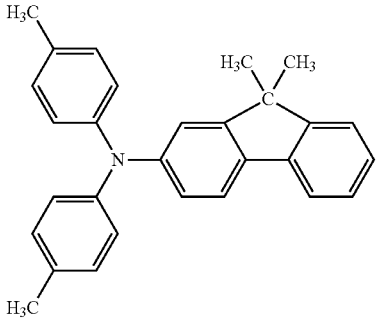

(1-2)

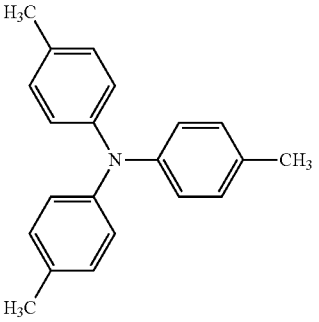

(1-3)

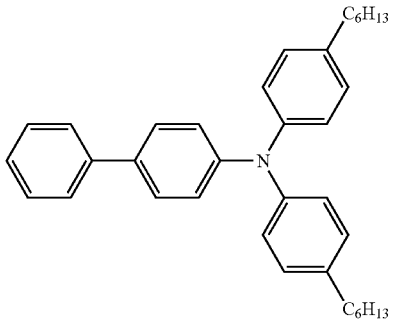

(1-4)

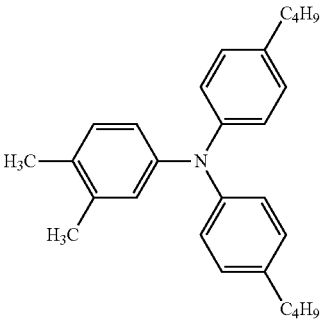

-continued (1-5)

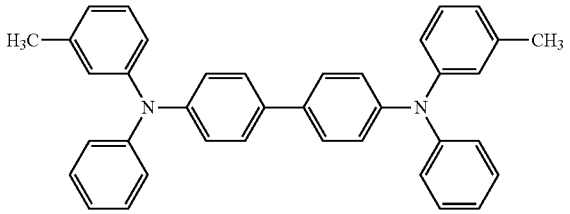

(1-6)

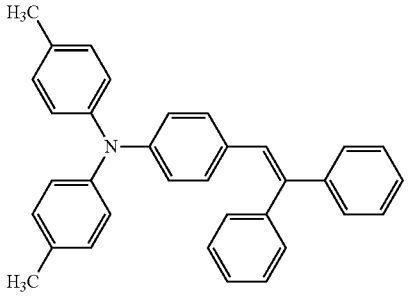

(1-7)

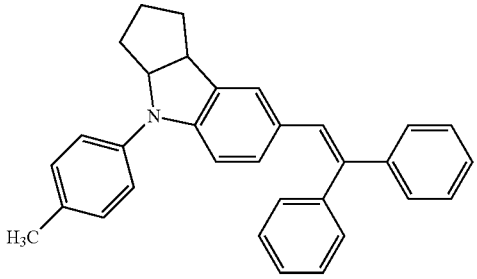

(1-8)

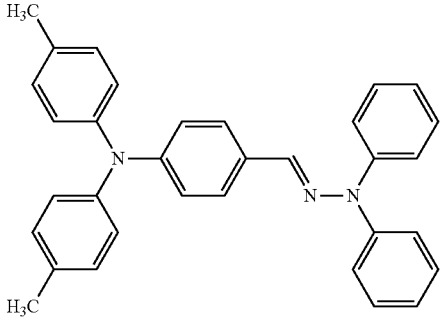

(1-9)

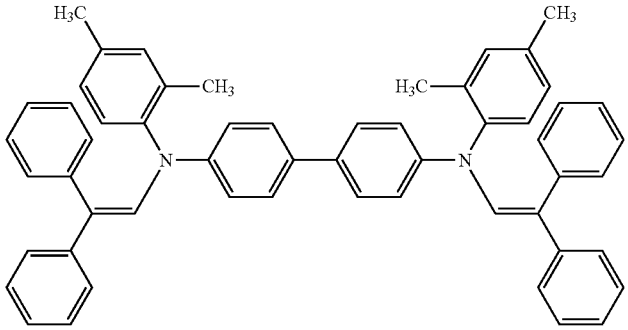

(1-10)

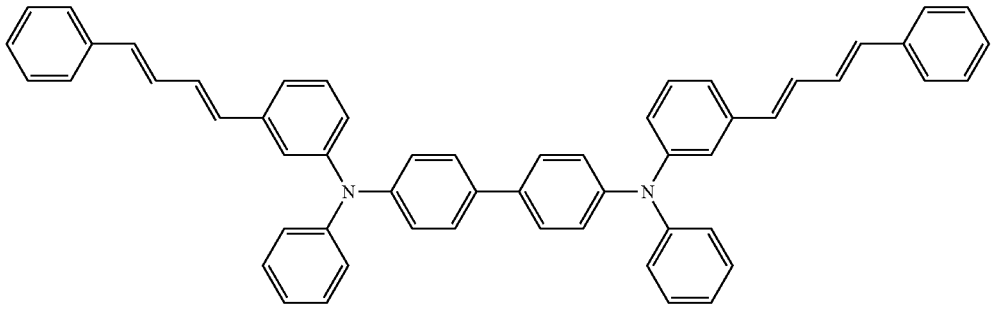

The binder resin may include polystyrene resins, polyacrylic resins, polycarbonate resins and polyester resins. In particular, it may preferably be a polycarbonate resin or a polyester resin. It may further preferably be a polycarbonate resin having a repeating structural unit represented by the following formula (2) or a polyester resin having a repeating structural unit represented by the following formula (3)

(2)

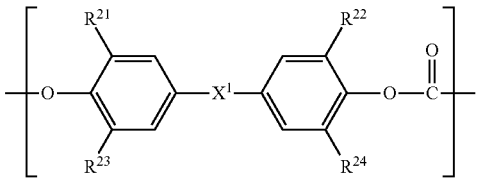

In the formula (2), $R^{21}$ to $R^{24}$ each independently represent a hydrogen atom or a methyl group. $X^1$ represents a single bond, a methylene group, an ethylidene group, a propylidene group, a phenylethylidene group, a cyclohexylidene group or an oxygen atom.

(3)

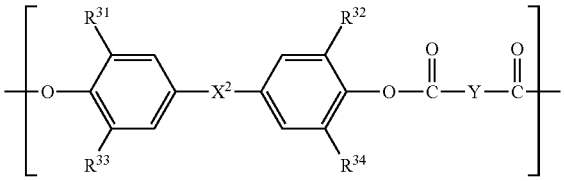

In the formula (3), $R^{31}$ to $R^{34}$ each independently represent a hydrogen atom or a methyl group. $X^2$ represents a single bond, a methylene group, an ethylidene group, a propylidene group, a cyclohexylidene group or an oxygen atom. Y represents a m-phenylene group, a p-phenylene group or a divalent group in which two p-phenylene groups are bonded through an oxygen atom.

Specific examples of the polycarbonate resin and polyester resin are given below.

(2-1)

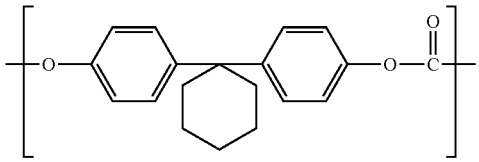

(2-2)

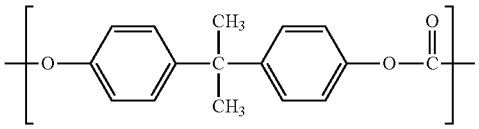

(2-3)

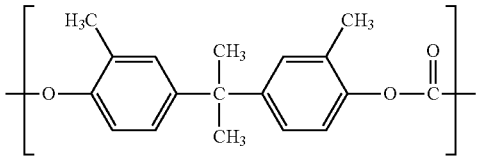

(2-4)

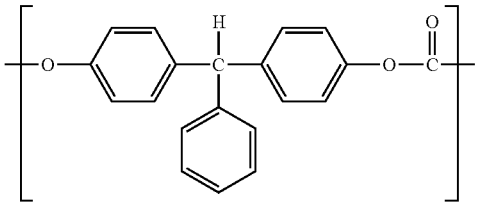

(2-5)

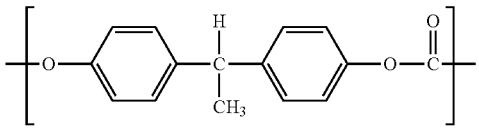

(2-6)

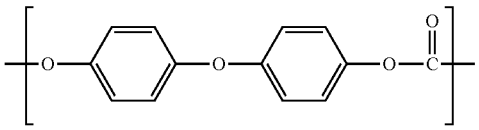

(2-7)

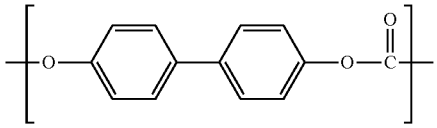

(2-8)

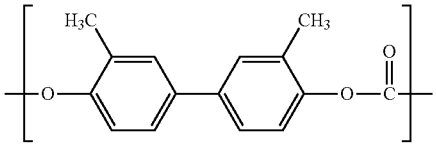

(3-1)

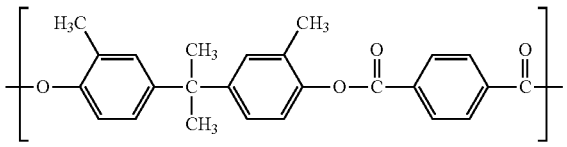

(3-2)

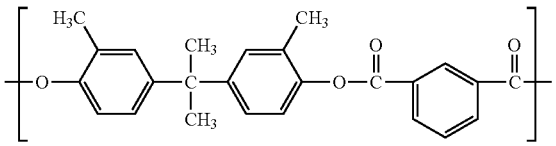

(3-3)

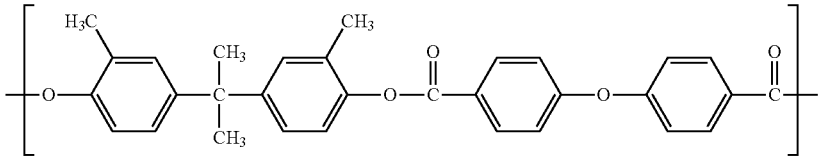

(3-4)

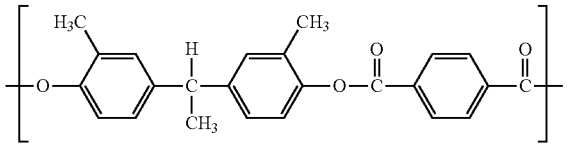

(3-5)

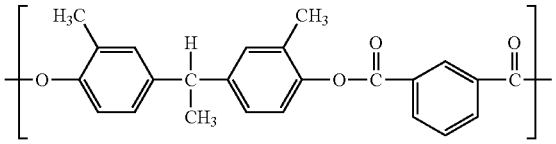

-continued (3-6)

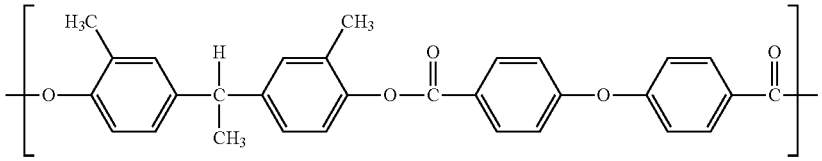

The weight average molecular weight of the binder resin described in regard to the present invention refers to weight average molecular weight in terms of polystyrene as measured by a conventional method, stated specifically, the method described in Japanese Patent Application Laid-open No. 2007-79555.

In the charge transporting layer, additives may be contained besides the charge transporting material and the binder resin. Such additives may include, e.g., deterioration preventives such as an antioxidant, an ultraviolet absorber and a light stabilizer, and releasability-providing resins. The deterioration preventives may include, e.g., hindered phenol type antioxidants, hindered amine type light stabilizers, sulfur atom-containing antioxidants and phosphorus atom-containing antioxidants. The releasability-providing resins may include, e.g., fluorine atom-containing resins and resins containing a siloxane structure.

The particles containing a charge transporting material refer to particles containing at least the above charge transporting material in the interiors of particles. A plurality of kinds of charge transporting materials may be contained in the same particle. The above additives may also be contained in each particle containing the charge transporting material(s). Particles containing a different charge transporting material may still also be mixedly used as particles containing a charge transporting material.

The particles containing a binder resin in the present invention refer to particles containing at least the above binder resin in the interiors of particles. A plurality of kinds of binder resins may be contained in the same particle. The above additives may also be contained in each particle containing the charge transporting material(s). Particles containing a different binder resin may still also be mixedly used as particles containing a binder resin.

The particles containing both a charge transporting material and a binder resin refer to particles containing at least both the above charge transporting material and the above binder resin in the interiors of same particles. A plurality of kinds of charge transporting materials may be contained in the same particle, and also a plurality of kinds of binder resins may be contained in the same particle. The above additives may also be contained in each particle containing both the charge transporting material(s) and the binder resin(s). Particles containing both a different charge transporting material and a different binder resin may still also be mixedly used as particles containing both a charge transporting material and a binder resin.

As methods for producing the particles containing the charge transporting material and the particles containing the binder resin, any existing methods for producing particles may be used. As methods for producing the particles containing both the charge transporting material and the binder resin, any existing methods for producing particles may also be used.

As specific methods for producing particles, a grinding method and a spray drying method are shown below, but not limited thereto.

The grinding method includes methods such as dry-process grinding, wet-process grinding and freeze grinding, and any method may be selected which accords with the qualities and types of the charge transporting material, binder resin and additives that are object materials from which the particles are produced. As a grinding machine, a grinding machine suited to grind soft materials, elastic materials or resinous materials is preferable, and may include, e.g., Ultra Centrifugal Mill, Rotor Beater Mill, Grind Mix and Mixer Mill. Where particles of the respective materials constituting the charge transporting layer are produced by using any of these grinding machines, the particles are produced by using a grinding machine suited for such materials. Also, where the particles containing both the charge transporting material and the binder resin are produced and where the particles containing in the same particle a plurality of kinds of materials constituting the charge transporting layer are produced, the object materials are treated by mixing such as kneading before they are treated by the grinding machine, to produce the particles.

The spray drying method is a method which is called spray dry or spray drying, and is advantageous in that particles with a high uniformity can be produced. This method is so set up that the materials standing dissolved or dispersed in a solvent or in a dispersion medium are sprayed to form particles while removing the solvent or dispersion medium and the particles formed are collected by means of a cyclone.

A case in which the particles containing the charge transporting material and the particles containing the binder resin are produced by the spray drying method is described. A case in which the particles containing both the charge transporting material and the binder resin are produced by the spray drying method is also described.

In the case in which the particles containing the charge transporting material are produced, a solution containing the charge transporting material is prepared by dissolving the charge transporting material in a solvent capable of dissolving the charge transporting material. Such a solution may be in a concentration of from 2% by mass to 15% by mass, and this is preferable in that the particles to be obtained can be produced in a small particle diameter and in a good uniformity. This solution is sprayed with drying by means of a spray dry equipment to produce particles containing the charge transporting material. The particles may have particle diameters of from 2 μm to 15 μm, and this is preferable in view of the uniformity in layer thickness at the time of film formation. The particles containing the binder resin are produced in the like way. In regard to the binder resin, too, a solution containing the binder resin is prepared. Such a solution may be in a concentration of from 1% by mass to 10% by mass, and this is preferable in that particles with a high uniformity can be obtained at the stage of producing the particles. This solution is sprayed with drying by means of a spray dry equipment to produce particles containing the binder resin. The particles may have particle diameters of from 2 μm to 15 μm, and this is preferable in view of the uniformity in layer thickness at the time of film formation.

In the case in which the particles containing both the charge transporting material and the binder resin are produced, a solution is prepared by dissolving the charge transporting material and the materials constituting the charge transporting layer, in a solvent capable of dissolving these. Such a solution may be in a concentration of from 1% by mass to 10% by mass, and this is preferable in that particles with a high uniformity can be obtained at the stage of producing the particles. This solution is sprayed with drying by means of a spray dry equipment to produce the particles containing both the charge transporting material and the binder resin. The particles may have particle diameters of from 2 μm to 15 μm, and this is preferable in view of the uniformity in layer thickness at the time of film formation.

The liquid dispersion comprised of the aqueous dispersion medium, the particles containing the charge transporting material and the particles containing the binder resin are described next. The liquid dispersion comprised of the aqueous dispersion medium and the particles containing both the charge transporting material and the binder resin are also described.

As the aqueous dispersion medium, it refers to a liquid capable of dispersing therein the particles containing the charge transporting material and the particles containing the binder resin and capable of maintaining the state of dispersion of both the particles. That it is capable of maintaining the state of dispersion of both the particles containing the charge transporting material and the particles containing the binder resin refers to that the particles having been dispersed in the aqueous dispersion medium can maintain the state that the particles do not come to coalesce or bind with one another. In another embodiment, as the aqueous dispersion medium, it also refers to a liquid capable of dispersing therein the particles containing both the charge transporting material and the binder resin and capable of maintaining the state of dispersion of both the particles. That it is capable of maintaining the state of dispersion of the particles containing both the charge transporting material and the binder resin refers to that both the particles having been dispersed in the aqueous dispersion medium can maintain the state that the particles do not come to coalesce or bind with one another.

As the aqueous dispersion medium, a liquid that may show the property of being slightly soluble to both the particles containing the charge transporting material and the particles containing the binder resin is used as an aqueous dispersion medium. Where a liquid that is different in kind from the liquid that may show the property of being slightly soluble to both the particles containing the charge transporting material and the particles containing the binder resin is used in the form of a mixture, such a liquid is mixed in an amount which is so controlled that the aqueous dispersion medium having been mixed with the liquid may show the property of being slightly soluble to the above particles, and the mixture obtained is used as the aqueous dispersion medium. As an index for the liquid showing the property of being slightly soluble to both the particles containing the charge transporting material and the particles containing the binder resin, a liquid in which some particles coming to dissolve when the liquid and the above particles are mixed together are in an amount of 0.5% by mass or less is regarded to have the property of being slightly soluble.

As the aqueous dispersion medium, in the other embodiment, a liquid that may show the property of being slightly soluble to the particles containing both the charge transporting material and the binder resin is also used as an aqueous dispersion medium. Where a liquid that is different in kind from the liquid that may show the property of being slightly soluble to the particles containing both the charge transporting material and the binder resin is used in the form of a mixture, such a liquid is mixed in an amount which is so controlled that the aqueous dispersion medium having been mixed with the liquid may show the property of being slightly soluble to the above particles, and the mixture obtained is used as the aqueous dispersion medium. As an index for the liquid showing the property of being slightly soluble to the particles containing both the charge transporting material and the binder resin, a liquid in which some particles coming to dissolve when the liquid and the above particles are mixed together are in an amount of 0.5% by mass or less is regarded to have the property of being slightly soluble.

As the liquid showing the property of being slightly soluble to both the particles containing the charge transporting material and the particles containing the binder resin, it may preferably be water, methanol or ethanol. The liquid showing the property of being slightly soluble to both the particles containing the charge transporting material and the particles containing the binder resin may be contained in an amount of 60% by mass or more, based on the total mass of the aqueous dispersion medium, and this is preferable in that the state of dispersion is maintained.

Water may preferably be contained in the aqueous dispersion medium in an amount of 30% by mass or more, based on the total mass of the aqueous dispersion medium, and this is preferable in that the state of dispersion is maintained. Much preferably, water may be contained in the aqueous dispersion medium in an amount of 40% by mass or more, based on the total mass of the aqueous dispersion medium, and this is much preferable in that the state of dispersion is maintained. In the case in which methanol and ethanol are contained in the aqueous dispersion medium, the total content of the content of the water and the content of at least one selected from the group consisting of the methanol and ethanol may preferably be 60% by mass or more, based on the total mass of the aqueous dispersion medium.

Likewise, as the liquid showing the property of being slightly soluble to the particles containing both the charge transporting material and the binder resin, it may preferably be water, methanol or ethanol. The liquid showing the property of being slightly soluble to the particles containing both the charge transporting material and the binder resin may be contained in an amount of 60% by mass or more, based on the total mass of the aqueous dispersion medium, and this is preferable in that the state of dispersion is maintained.

Water may preferably be contained in the aqueous dispersion medium in an amount of 30% by mass or more, based on the total mass of the aqueous dispersion medium, and this is preferable in that the state of dispersion is maintained. Much preferably, water may be contained in the aqueous dispersion medium in an amount of 40% by mass or more, based on the total mass of the aqueous dispersion medium, and this is much preferable in that the state of dispersion is maintained. In the case in which methanol and ethanol are contained in the aqueous dispersion medium, the total content of the content of the water and the content of at least one selected from the group consisting of the methanol and ethanol may preferably be 60% by mass or more, based on the total mass of the aqueous dispersion medium.

As constitution of the aqueous dispersion medium, it may contain a liquid other than the liquid showing the property of being slightly soluble to both the particles containing the charge transporting material and the particles containing the binder resin, as long as it does not damage the dispersibility and dispersion stability of the particles. As constitution of the aqueous dispersion medium in the other embodiment, it may also contain a liquid other than the liquid showing the property of being slightly soluble to the particles containing both the charge transporting material and the binder resin, as long as it does not damage the dispersibility and dispersion stability of the particles.

The liquid other than the liquid showing the property of being slightly soluble as above may include liquids of an ether type, liquids of an alcohol type having 3 or more carbon atoms, liquids of a ketone type, liquids composed of aliphatic hydrocarbons, and liquids having an aromatic ring structure.

The liquids of an ether type may include chain ethers such as methoxymethane and dimethoxymethane, and cyclic ethers such as tetrahydrofuran (or oxolane). The liquids of an alcohol type having 3 or more carbon atoms may include propanol and butanol. The liquids of a ketone type may include acetone and methyl ethyl ketone. The liquids composed of aliphatic hydrocarbons may include chain hydrocarbons such as pentane and hexane, and cyclic hydrocarbons such as cyclopentane and cyclohexane. The liquids having an aromatic ring structure may include toluene and xylene. In particular, the liquids of an ether type are preferable because difficulties such as the coalescence of particles can not easily occur even when any of them is contained in the aqueous dispersion medium in a large quantity. On the other hand, the liquids composed of aliphatic hydrocarbons and the liquids having an aromatic ring structure may cause the coalescence of particles when contained in the aqueous dispersion medium in a large quantity.

As dispersion methods for preparing the liquid dispersion, any existing dispersion methods may be used. As specific dispersion methods, a stirring method and a high-pressure impact method are shown below, but not limited thereto.

The stirring method is described below.

The particles containing the charge transporting material, the particles containing the binder resin, and the aqueous dispersion medium are weighed, blended or mixed and thereafter stirred by means of a stirrer to make up the liquid dispersion. In the other embodiment, the particles containing both the charge transporting material and the binder resin, and the aqueous dispersion medium are weighed, mixed and thereafter stirred by means of a stirrer to make up the liquid dispersion. As the stirrer, it may be a stirrer that can carry out high-pressure stirring, and this is preferable in that the materials can uniformly be stirred in a short time. The stirrer may include a homogenizer.

The particles containing the charge transporting material and the particles containing the binder resin may be held in the liquid dispersion in an amount of from 10% by mass to 30% by mass based on the mass of the liquid dispersion. The particles containing the charge transporting material and the particles containing the binder resin may preferably be in a proportion in the range of from 4:10 to 20:10 (mass ratio), and much preferably in the range of from 5:10 to 12:10 (mass ratio). The amount in which the particles containing the charge transporting material and the particles containing the binder resin are blended is so controlled as for them to be in such a ratio.

The particles containing both the charge transporting material and the binder resin may also be held in the liquid dispersion in an amount of from 10% by mass to 30% by mass based on the mass of the liquid dispersion. The charge transporting material and binder resin in the particles containing both the charge transporting material and the binder resin may preferably be in a proportion in the range of from 4:10 to 20:10 (mass ratio), and much preferably in the range of from 5:10 to 12:10 (mass ratio). The amount in which the charge transporting material and the binder resin are mixed is so controlled as for them to be in such a ratio at the stage where the particles are produced.

The high-pressure impact method is described next. This method can not effect dispersion if the aqueous dispersion medium has a low boiling point, and hence it is preferable to use water as the aqueous dispersion medium in carrying out dispersion. After a liquid dispersion has been prepared using water, the other liquid may be mixed therewith, followed by dispersion by means of a dispersion machine to make up the liquid dispersion. The dispersion machine may include Microfluidizer.

Forming a coat of the liquid dispersion is described below.

In regard to how to form the coat of the liquid dispersion, it may be managed by any of existing coating methods such as dip coating, spray coating and ring coating. It is preferable to be done by dip coating, from the viewpoint of productivity. Through this step, the liquid dispersion is coated on the support, thus the coat can be formed.

The step of heating the coat at a temperature not less than the melting point of the charge transporting material to form the charge transporting layer is described next.

In the present invention, the liquid dispersion comprised of the particles containing the charge transporting material and the particles containing the binder resin is coated, and hence it is necessary to remove the aqueous dispersion medium by heating and at the same time make the particles join with one another. Also, in the other embodiment of the present invention, the liquid dispersion comprised of the particles containing both the charge transporting material and the binder resin is coated, and hence it is necessary to remove the aqueous dispersion medium by heating and at the same time make the particles join with one another.

In respect of improving the joining (joinability) of the particles, the temperature at which the coat is heated is temperature not less than the melting point of a charge transporting material having the lowest melting point among charge transporting materials constituting the charge transporting layer, where a coat with a high uniformity can be formed. This is because the charge transporting material melts upon the heating at the temperature not less than the melting point of the charge transporting material and the binder resin dissolves in a molten product of the charge transporting material, thus this has improved the coat in its uniformity.

The charge transporting material to be contained in the charge transporting layer may be a charge transporting material having a melting point lower than that of the binder resin to be contained in the charge transporting layer. This is preferable for the production process of the present invention. Also, the charge transporting material to be contained in the charge transporting layer may be in a large quantity in the liquid dispersion, and this is preferable for the production process of the present invention.

As the temperature at which the coat is heated, it is preferable for the coat to be heated at a temperature higher by 5° C. or more, than the melting point of the charge transporting material having the lowest melting point among charge transporting materials constituting the charge transporting layer. This temperature may also preferably be 200° C. or less because any too high temperature at which the coat is heated may cause changes in property of the charge transporting material.

The charge transporting layer of the electrophotographic photosensitive member produced by the production process of the present invention may preferably be formed in a layer thickness of from 5 μm or more to 50 μm or less, and much preferably from 10 μm or more to 35 μm or less.

In the present invention, the aqueous dispersion medium comprised of the particles containing the charge transporting material and the particles containing the binder resin is prepared. This makes the liquid dispersion not agglomerate even where the liquid dispersion is stored for a long term, and hence brings a result that is advantageous in manufacture. In the method disclosed in Japanese Patent Application Laid-open No. 2011-128213, in which a charge transporting material and a binder resin are dissolved in an organic solvent to form an oil-in-water emulsion, the charge transporting material and the binder resin are present in oil droplets formed from the solution present in water, where, however, since the organic solvent is contained in a large quantity and the oil droplets are formed, the oil droplets tend to come to agglomerate (coalesce) when stored for a long term. The term for which the state of dispersion is maintained may be prolonged by incorporating a surface-active agent in a large quantity, but it is difficult to maintain the state of oil droplets for a long term. In the present invention, the aqueous dispersion medium comprised of the particles containing the charge transporting material and the particles containing the binder resin is used, and this enables the liquid dispersion to be prepared without formation of the state of oil droplets. Hence, the liquid dispersion can vastly be kept from coming to agglomerate. Thus, the state of dispersion can be maintained even after it has been stored for a long term.

In the other embodiment of the present invention, the liquid dispersion comprised of the particles containing both the charge transporting material and the binder resin is prepared. This makes the liquid dispersion not agglomerate even where the liquid dispersion is stored for a long term, and hence brings a result that is advantageous in manufacture. Like the above, in the present invention, the aqueous dispersion medium comprised of the particles containing both the charge transporting material and the binder resin is used, and this enables the liquid dispersion to be prepared without formation of the state of oil droplets. Hence, the liquid dispersion can vastly be kept from coming to agglomerate. Thus, the state of dispersion can be maintained even after it has been stored for a long term.

How an electrophotographic photosensitive member produced by the electrophotographic photosensitive member production process is constituted is described next.

The electrophotographic photosensitive member production process as described above is a process for producing an electrophotographic photosensitive member having a support and a charge generation layer and the above charge transporting layer which are formed on the support.

The electrophotographic photosensitive member is commonly a cylindrical electrophotographic photosensitive member having a cylindrical support and formed thereon a photosensitive layer, which is widely used, but may also be one having the shape of a belt or the shape of a sheet.

As the support, it may preferably be one having conductivity (conductive support), and usable are supports made of a metal such as aluminum, aluminum alloy or stainless steel. In the case of the support made of aluminum or aluminum alloy, usable are an ED pipe, an EI pipe and those obtained by subjecting these pipes to cutting, electrolytic composite polishing or wet-process or dry-process honing. Still also usable are supports made of a metal, or supports made of a resin, having layers film-formed by vacuum deposition of aluminum, an aluminum alloy or an indium oxide-tin oxide alloy. Still also usable are supports formed of resin or the like impregnated with conductive particles such as carbon black, tin oxide particles, titanium oxide particles or silver particles, and supports made of a plastic containing a conductive resin.

The surface of the support may be subjected to cutting, surface roughening or aluminum anodizing.

A conductive layer may be provided between the support and an intermediate layer described later or a charge generation layer described later. This is a layer formed by coating the support with a conductive layer coating fluid prepared by dispersing conductive particles in a resin. The conductive particles may include, e.g., carbon black, acetylene black, metallic powders of aluminum, nickel, iron, nichrome, copper, zinc and silver, and metal oxide powders such as conductive tin oxide and ITO. The resin may include, e.g., polyester resins, polycarbonate resins, polyvinyl butyral resins, acrylic resins, silicone resins, epoxy resins, melamine resins, urethane resins, phenol resins and alkyd resins.

A solvent of the conductive layer coating fluid may include, e.g., ether type solvents, alcohol type solvents, ketone type solvents and aromatic hydrocarbon solvents.

The conductive layer may preferably have a layer thickness of from 0.2 μm or more to 40 μm or less, much preferably from 1 μm or more to 35 μm or less, and further preferably from 5 μm or more to 30 μm or less.

An intermediate layer may also be provided between the support or conductive layer and a charge generation layer. The intermediate layer may be formed by coating on the conductive layer an intermediate layer coating fluid containing a resin, and drying or curing the wet coat formed.

The resin for the intermediate layer may include, e.g., polyacrylic acids, methyl cellulose, ethyl cellulose, polyamide resins, polyimide resins, polyamide-imide resins, polyamic acid resins, melamine resins, epoxy resins, polyurethane resins and polyolefin resins. The resin for the intermediate layer may preferably be a thermoplastic resin. Stated specifically, a thermoplastic, polyamide resin or polyolefin resin is preferred. As the polyamide resin, a low-crystallizable or non-crystallizable copolymer nylon is preferred as being able to be coated in the state of a solution. As the polyolefin resin, it is preferable to be in a state usable as a particle liquid dispersion. It is further preferable that the polyolefin resin stands dispersed in an aqueous medium.

The intermediate layer may preferably have a layer thickness of from 0.05 μm or more to 7 μm or less, and much preferably from 0.1 μm or more to 2 μm or less.

In the intermediate layer, semiconductive particles, an electron transport material or an electron accepting material may be incorporated.

The charge generation layer is provided on the support, on the conductive layer or on the intermediate layer.

A charge generating material used in the charge generation layer of the electrophotographic photosensitive member of the present invention may include, e.g., azo pigments, phthalocyanine pigments, indigo pigments and perylene pigments. Any of these charge generating materials may be used alone or in combination of two or more types. Of these, particularly preferred are metal phthalocyanines such as oxytitanium phthalocyanine, hydroxygallium phthalocyanine and chlorogallium phthalocyanine, as having a high sensitivity.

A resin used for the charge generation layer may include, e.g., polycarbonate resins, polyester resins, butyral resins, polyvinyl acetal resins, acrylic resins, vinyl acetate resins and urea resins. Of these, butyral resins are particularly preferred. Any of these may be used alone or in the form of a mixture or copolymer of two or more types.

The charge generation layer may be formed by coating a charge generation layer coating fluid obtained by dispersing the charge generating material together with the resin and a solvent, and drying the wet coat formed. The charge generation layer may also be a vacuum-deposited film of the charge generating material. As a method for dispersion, a method is available which makes use of a homogenizer, ultrasonic waves, a ball mill, a sand mill, an attritor or a roll mill.

The charge generating material and the binder resin may preferably be in a proportion in the range of from 1:10 to 10:1 (mass ratio), and, in particular, much preferably from 1:1 to 3:1 (mass ratio).

The solvent used for the charge generation layer coating fluid may be selected taking account of the resin to be used and the solubility or dispersion stability of the charge generating material. As an organic solvent, it may include, e.g., alcohol type solvents, sulfoxide type solvents, ketone type solvents, ether type solvents, ester type solvents and aromatic hydrocarbon solvents.

The charge generation layer may preferably have a layer thickness of 5 μm or less, and much preferably from 0.1 μm or more to 2 μm or less.

A sensitizer, an antioxidant, an ultraviolet absorber and a plasticizer which may be of various types may also optionally be added to the charge generation layer. An electron transport material or an electron accepting material may also be incorporated in the charge generation layer in order to make the flow of electric charges not stagnate in the charge generation layer.

On the charge generation layer, the charge transporting layer is provided. The charge transporting layer in the present invention is formed in the manner shown in the production process described above.

Various additives may be added to the respective layers of the electrophotographic photosensitive member in the present invention. Such additives may include, e.g., deterioration preventives such as an antioxidant, an ultraviolet absorber and a light stabilizer, and particles such as organic particles or inorganic particles. The deterioration preventives may include, e.g., hindered phenol type antioxidants, hindered amine type light stabilizers, sulfur atom-containing antioxidants and phosphorus atom-containing antioxidants. The organic particles may include high-polymer resin particles such as fluorine atom-containing resin particles, polystyrene particles and polyethylene resin particles. The inorganic particles may include, e.g., metal oxide particles such as silica particles and alumina particles.

When the above respective layer coating fluids are coated, any coating method may be used, such as dip coating, spray coating, spinner coating, roller coating, Meyer bar coating, blade coating or ring coating.

On the surface of the charge transporting layer that is a surface layer of the electrophotographic photosensitive member in the present invention, a hill-and-dale profile (hollow-shaped and/or hill-shaped unevenness) may also be formed. As a method of forming such a hill-and-dale profile, any known method may be employed. As methods of forming the same, available are a method in which abrasive particles are sprayed on the surface to form a hollow-shaped unevenness, a method in which a mold having a hill-and-dale profile is brought into pressure contact with the surface to form a hollow- and hill-shaped unevenness, and a method in which the surface is irradiated with laser beams to form a hollow-shaped unevenness. Of these, preferred is the method in which a mold having a hill-and-dale profile is brought into pressure contact with the surface of the surface layer of the electrophotographic photosensitive member to form a hollow- and hill-shaped unevenness.

An example of the construction of an electrophotographic apparatus provided with a process cartridge having the electrophotographic photosensitive member of the present invention is schematically shown in FIG. 1.

In FIG. 1, reference numeral 1 denotes a cylindrical electrophotographic photosensitive member, which is rotatingly driven around a shaft 2 in the direction of an arrow at a stated peripheral speed.

The surface of the electrophotographic photosensitive member 1 rotatingly driven is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer a developing means 5 has, to form toner images. Then, the toner images thus formed and held on the surface of the electrophotographic photosensitive member 1 are successively transferred by applying a transfer bias from a transfer means (such as a transfer roller) 6, which are successively transferred on to a transfer material (such as paper) P fed from a transfer material feed means (not shown) to the part (contact zone) between the electrophotographic photosensitive member 1 and the transfer means 6 in the manner synchronized with the rotation of the electrophotographic photosensitive member 1.

The transfer material P to which the toner images have been transferred is separated from the surface of the electrophotographic photosensitive member 1 and led into a fixing means 8, where the toner images are fixed, and is then put out of the apparatus as an image-formed material (a print or a copy).

The surface of the electrophotographic photosensitive member 1 from which the toner images have been transferred is brought to removal of the developer (toner) remaining after the transfer, through a cleaning means (such as a cleaning blade) 7. Thus, its surface is cleaned. Then, this surface is subjected to charge elimination by pre-exposure light (not shown) emitted from a pre-exposure means (not shown), and thereafter repeatedly used for the formation of images. Incidentally, where as shown in FIG. 1 the charging means 3 is a contact charging means making use of, e.g., a charging roller, the pre-exposure is not necessarily required.

The apparatus may be constituted of a combination of a plurality of components integrally joined in a container as a process cartridge from among the constituents such as the above electrophotographic photosensitive member 1, charging means 3, developing means 5, transfer means 6 and cleaning means 7. This process cartridge may also be so set up as to be detachably mountable to the main body of an electrophotographic apparatus such as a copying machine or a laser beam printer. In the apparatus shown in FIG. 1, the electrophotographic photosensitive member 1 and the charging means 3, developing means 5 and cleaning means 7 are integrally supported to form a cartridge to set up a process cartridge 9 that is detachably mountable to the main body of the electrophotographic apparatus through a guide means 10 such as rails provided in the main body of the electrophotographic apparatus.

EXAMPLES

Specific liquid dispersion preparation examples and working examples are given below. However, the present invention is by no means limited to these. In the following Examples, "part(s)" refers to "part(s) by mass".

Liquid Dispersion Preparation Example 1

A liquid dispersion comprised of particles containing a charge transporting material and particles containing a binder resin was prepared in the following way.

As a charge transporting material 100 parts of the compound represented by the formula (1-1) (melting point: 145° C.) was dissolved in 900 parts of o-xylene. Using the o-xylene solution obtained and using Mini Spray Dryer B-290 connected with Inert Loop B-295 (both manufactured by BUCHI Labotechnik AG), the solution was converted into particles by spray drying in a stream of nitrogen and while collecting the solvent. The setting of nitrogen gas flow rate, inlet temperature, an aspirator and a pump was so controlled that the resultant particles containing the charge transporting material might have particle diameters of 2 to 10 μm. Thus, particles containing the charge transporting material were produced.

Next, as a binder resin 20 parts of the polycarbonate resin having a repeating structural unit represented by the formula (2-1) (weight average molecular weight Mw: 80,000) was dissolved in 980 parts of o-xylene. The o-xylene solution obtained was converted into particles by the same spray drying as the above. The setting of nitrogen gas flow rate, inlet temperature, an aspirator and a pump was so controlled that the resultant particles containing the binder resin might have particle diameters of 2 to 10 μm. Thus, particles containing the binder resin were produced.

Next, as solid matter 10 parts of the particles containing the charge transporting material and 10 parts of the particles containing the binder resin and as an aqueous dispersion medium a combination of 40 parts of water and 40 parts of methanol (water/methanol=5/5) were weighed and mixed. The liquid mixture obtained was stirred for 20 minutes under conditions of 5,000 revolutions per minute by using a homogenizer. Thus, a liquid dispersion comprised of the particles containing the charge transporting material and the particles containing the binder resin was obtained.

The stability of the liquid dispersion obtained was evaluated. As an evaluation method, the liquid dispersion was left to stand for 2 weeks after it was prepared in the way described above. How it stood after leaving was observed, and thereafter this liquid dispersion was stirred for 3 minutes at 1,000 revolutions per minute by using a homogenizer. How the liquid dispersion stood after stirring was likewise observed. Here, the evaluation by visual observation before and after leaving was made in the state that the liquid dispersion was diluted twice with water and thereafter put into a cell of 1 cm×1 cm.

The liquid dispersion obtained in Liquid Dispersion Preparation Example 1 was, after leaving as above, in such a state that its particles were seen to have settled. Any agglomeration of particles was not seen in the liquid dispersion obtained upon the stirring.

Liquid Dispersion Preparation Examples 2 to 10

Particles containing a charge transporting material and particles containing a binder resin were produced in the same way as Liquid Dispersion Preparation Example 1. Next, liquid dispersions were obtained in the same way as Liquid Dispersion Preparation Example 1 except that the composition and compositional ratio of each aqueous dispersion medium were changed as shown in Table 1. These liquid dispersions were evaluated in the same way as Liquid Dispersion Preparation Example 1. Evaluation results on the stability of the liquid dispersions obtained are also shown in Table 1.

Liquid Dispersion Preparation Example 11

Particles containing a charge transporting material and particles containing a binder resin were produced in the same way as Liquid Dispersion Preparation Example 1. Next, as solid matter 10 parts of the particles containing the charge transporting material and 10 parts of the particles containing the binder resin and as an aqueous dispersion medium a combination of 40 parts of water, 32 parts of methanol and 8 parts of dimethoxymethane (water/methanol/dimethoxymethane=3/3/4) were weighed and mixed. The liquid mixture obtained was stirred in the same way as Liquid Dispersion Preparation Example 1 to obtain a liquid dispersion comprised of the particles containing the charge transporting material and the particles containing the binder resin. This liquid dispersion was evaluated in the same way as Liquid Dispersion Preparation Example 1. Evaluation results on the stability of the liquid dispersion obtained are also shown in Table 1.

Liquid Dispersion Preparation Examples 12 to 16

Particles containing a charge transporting material and particles containing a binder resin were produced in the same way as Liquid Dispersion Preparation Example 1. Next, liquid dispersions were obtained in the same way as Liquid Dispersion Preparation Example 11 except that the composition and compositional ratio of each aqueous dispersion medium were changed as shown in Table 1. These liquid dispersions were evaluated in the same way as Liquid Dispersion Preparation Example 1. Evaluation results on the stability of the liquid dispersions obtained are also shown in Table 1.

Liquid Dispersion Preparation Examples 17 to 22

Liquid Dispersions were prepared in the same way as Liquid Dispersion Preparation Example 1 except that the compound represented by the formula (1-2) (melting point: 116° C.) was used as the charge transporting material and the polycarbonate resins having repeating structural units represented by the formula (2-2) and formula (2-3) [(2-2)/(2-3)=5/5; Mw: 70,000] were used as binder resins and that aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Examples 23 to 25

Liquid Dispersions were prepared in the same way as Liquid Dispersion Preparation Example 1 except that the compound represented by the formula (1-3) (melting point: 85° C.) was used as the charge transporting material and the polycarbonate resins having repeating structural units represented by the formula (2-3) and formula (2-4) [(2-3)/(2-4)=7/3; Mw: 50,000] were used as binder resins and that aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Examples 26 to 28

Liquid Dispersions were prepared in the same way as Liquid Dispersion Preparation Example 1 except that the compound represented by the formula (1-4) (melting point: 120° C.) was used as the charge transporting material and the polycarbonate resins having repeating structural units represented by the formula (2-3) and formula (2-6) [(2-3)/(2-6)=7/3; Mw: 50,000] were used as binder resins and that aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Example 29

Particles containing as a charge transporting material the compound represented by the formula (1-1) were produced in the same way as Liquid Dispersion Preparation Example 1 and further, particles containing the compound represented by the formula (1-5) (melting point: 169° C.) were produced under the like conditions in Liquid Dispersion Preparation Example 1.

Next, particles containing a binder resin were produced in the same way as Liquid Dispersion Preparation Example 1, but using the polycarbonate resin having the repeating structural unit represented by the formula (2-1) (weight average molecular weight Mw: 40,000).

Next, as solid matter 7 parts of the particles containing the compound represented by the formula (1-1), 3 parts of the compound represented by the formula (1-5) and 10 parts of the particles containing the binder resin and as an aqueous dispersion medium a combination of 40 parts of water and 40 parts of methanol (water/methanol=5/5) were weighed and mixed. The liquid mixture obtained was stirred for 20 minutes under conditions of 5,000 revolutions per minute by using a homogenizer. Thus, a liquid dispersion comprised of the particles containing the charge transporting material and the particles containing the binder resin was obtained. This liquid dispersion was evaluated in the same way as Liquid Dispersion Preparation Example 1. Evaluation results on the stability of the liquid dispersion obtained are also shown in Table 1.

Liquid Dispersion Preparation Examples 30 to 36

Two kinds of particles containing a charge transporting material and particles containing a binder resin were produced in the same way as Liquid Dispersion Preparation Example 29. Next, liquid dispersions were obtained in the same way as Liquid Dispersion Preparation Example 29 except that the composition and compositional ratio of each aqueous dispersion medium were changed as shown in Table 1. These liquid dispersions were evaluated in the same way as Liquid Dispersion Preparation Example 1. Evaluation results on the stability of the liquid dispersions obtained are also shown in Table 1.

Liquid Dispersion Preparation Examples 37 to 44

Two kinds of particles containing a charge transporting material were produced in the same way as Liquid Dispersion Preparation Example 29. Particles containing binder resins were produced in the same way as Liquid Dispersion Preparation Example 1, but using as binder resins the polyester resins having repeating structural units represented by the formula (3-1) and formula (3-2) [(3-1)/(3-2)=5/5; Mw: 110,000].

Next, liquid dispersions were prepared in the same way as Liquid Dispersion Preparation Example 1 except that the above particles were used in combination as shown in Table 1 and aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Examples 45 to 49

Two kinds of particles containing a charge transporting material were produced in the same way as Liquid Dispersion Preparation Example 29. Particles containing a binder resin were produced in the same way as Liquid Dispersion Preparation Example 1, but using as the binder resin the polyester resin having a repeating structural unit represented by the formula (3-6) (Mw: 90,000).

Next, liquid dispersions were prepared in the same way as Liquid Dispersion Preparation Example 1 except that the above particles were used in combination as shown in Table 1 and aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Example 50

A liquid dispersion comprised of particles containing both a charge transporting material and a binder resin was produced in the following way.

As a charge transporting material 20 parts of the compound represented by the formula (1-1) (melting point: 145° C.) and as a binder resin 20 parts of the polycarbonate resin having a repeating structural unit represented by the formula (2-1) (weight average molecular weight Mw: 80,000) were dissolved in 960 parts of o-xylene.

Using the o-xylene solution obtained, containing both the charge transporting material and the binder resin, and using Mini Spray Dryer B-290 connected with Inert Loop B-295 (both manufactured by BUCHI Labotechnik AG), the solution was converted into particles by spray drying in a stream of nitrogen and while collecting the solvent. The setting of nitrogen gas flow rate, inlet temperature, an aspirator and a pump was so controlled that the resultant particles containing both the charge transporting material and the binder resin might have particle diameters of 2 to 10 μm. Thus, the particles containing both the charge transporting material and the binder resin were produced.

Next, 20 parts of the particles containing both the charge transporting material and the binder resin, thus obtained, and as an aqueous dispersion medium a combination of 40 parts of water and 40 parts of methanol (water/methanol=5/5) were weighed and mixed. The liquid mixture obtained was stirred for 20 minutes under conditions of 5,000 revolutions per minute by using a homogenizer. Thus, a liquid dispersion comprised of the particles containing both the charge transporting material and the binder resin was obtained. This liquid dispersion was evaluated in the same way as Liquid Dispersion Preparation Example 1. Evaluation results on the stability of the liquid dispersion obtained are also shown in Table 1.

Liquid Dispersion Preparation Examples 51 to 53

Liquid Dispersions were prepared in the same way as Liquid Dispersion Preparation Example 50 except that aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Example 54

A liquid dispersion was obtained in the same way as Liquid Dispersion Preparation Example 50 except that, as the charge transporting materials, the compound represented by the formula (1-1) was used in an amount of 14 parts and 6 parts of the compound represented by the formula (1-5) was added. This liquid dispersion was evaluated in the same way as Liquid Dispersion Preparation Example 1. Evaluation results on the stability of the liquid dispersions obtained are also shown in Table 1.

Liquid Dispersion Preparation Examples 55 to 57

Liquid Dispersions were prepared in the same way as Liquid Dispersion Preparation Example 54 except that aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Example 58

A liquid dispersion was obtained in the same way as Liquid Dispersion Preparation Example 54 except that, as the charge transporting materials, the compound represented by the formula (1-1) and the compound represented by the formula (1-5) were used in amounts of 18 parts and 2 parts, respectively, and that, as the binder resin, it was changed for 20 parts of the polyester resin having repeating structural units represented by the formula (3-1) and formula (3-2) [(3-1)/(3-2)=5/5; Mw: 110,000]. This liquid dispersion was evaluated in the same way as Liquid Dispersion Preparation Example 1. Evaluation results on the stability of the liquid dispersions obtained are also shown in Table 1.

Liquid Dispersion Preparation Examples 59 to 61

Liquid Dispersions were prepared in the same way as Liquid Dispersion Preparation Example 58 except that aqueous dispersion mediums shown in Table 1 were used. These liquid dispersions were evaluated in the same way as Liquid Dispersion Preparation Example 1. Evaluation results on the stability of the liquid dispersions obtained are also shown in Table 1.

Liquid Dispersion Preparation Example 62

Particles containing both a charge transporting material and a binder resin were produced in the same way as Liquid Dispersion Preparation Example 1. Next, a liquid dispersion was obtained in the same way as Liquid Dispersion Preparation Example 1 except that as an aqueous dispersion medium a combination of 40 parts of water and 40 parts of methanol (water/methanol=5/5) and further as a surface-active agent 1 part of NAROACTY CL-70 (available from Sanyo Chemical Industries, Ltd.) were weighed and mixed. This liquid dispersion was evaluated in the same way as Liquid Dispersion Preparation Example 1. Evaluation results on the stability of the liquid dispersions obtained are also shown in Table 1.

Liquid Dispersion Preparation Example 63

A liquid dispersion was obtained in the same way as Liquid Dispersion Preparation Example 62 except that as the surface-active agent NAROACTY CL-85 (available from Sanyo Chemical Industries, Ltd.) was used. This liquid dispersion was evaluated in the same way as Liquid Dispersion Preparation Example 1. Evaluation results on the stability of the liquid dispersions obtained are also shown in Table 1.

Comparative Example 1

A coating fluid containing both a charge transporting material and a binder resin was prepared according to the process disclosed in Japanese Patent Application Laid-open No. 2011-128213.

As the charge transporting material 5 parts of the compound represented by the formula (1-5) and as the binder resin 5 parts of the polycarbonate resin having the repeating structural unit represented by the formula (2-1) (Mw: 80,000) were dissolved in 40 parts of toluene as an organic solvent to prepare 50 parts of an organic solution for charge transporting layer. Next, as a surface-active agent 1.5 parts of NAROACTY CL-85 was added to 50 parts of water, and, with stirring at a speed of 5,000 revolutions per minute by means of a homogenizer, 50 parts of the organic solution for charge transporting layer was added and these were stirred for 10 minutes. These were further stirred for 5 minutes, raising the number of revolutions to 7,000 revolutions per minute to prepare an emulsion type charge transporting layer coating fluid.

The stability of the emulsion type charge transporting layer coating fluid obtained was evaluated. As an evaluation method, the emulsion type charge transporting layer coating fluid prepared in the above way was left to stand for 2 weeks after it was prepared in the way described above. How it stood after leaving was observed, and thereafter this emulsion type charge transporting layer coating fluid was stirred for 3 minutes at 1,000 revolutions per minute by using a homogenizer. How the emulsion type charge transporting layer coating fluid stood after stirring was likewise observed.

The emulsion type charge transporting layer coating fluid obtained in Comparative Example 1 was, after leaving as above, in such a state that its oil droplet component was seen to have settled, and also some of the oil droplet component coalesced to make agglomerates seen on the bottom. In the emulsion type charge transporting layer coating fluid obtained upon the stirring, as being different from the emulsion type charge transporting layer coating fluid immediately after the coating fluid was prepared, the oil droplet component was seen to have agglomerated, and the state of a coating fluid with a high uniformity was not achievable.

Comparative Example 2

An emulsion type charge transporting layer coating fluid was prepared in the same way as Comparative Example 1 except that the compound represented by the formula (1-3) was used instead as the charge transporting material and xylene was used instead as the organic solvent. The stability of the emulsion type charge transporting layer coating fluid obtained was evaluated in the same way as Comparative Example 1. The results are shown in Table 2.

Comparative Example 3

An emulsion type charge transporting layer coating fluid was prepared in the same way as Comparative Example 1 except that the toluene as an organic solvent was used in an amount of 30 parts and the water in an amount of 60 parts. The stability of the emulsion type charge transporting layer coating fluid obtained was evaluated in the same way as Comparative Example 1. The results are shown in Table 2.

Comparative Example 4

An emulsion type charge transporting layer coating fluid was prepared in the same way as Comparative Example 2 except that the xylene as an organic solvent was used in an amount of 30 parts and the water in an amount of 60 parts. The stability of the emulsion type charge transporting layer coating fluid obtained was evaluated in the same way as Comparative Example 1. The results are shown in Table 2.

Comparative Example 5

An emulsion type charge transporting layer coating fluid was prepared in the same way as Comparative Example 1 except that the toluene as an organic solvent was used in an amount of 20 parts and the water in an amount of 70 parts. The stability of the emulsion type charge transporting layer coating fluid obtained was evaluated in the same way as Comparative Example 1. The results are shown in Table 2.

Comparative Example 6

An emulsion type charge transporting layer coating fluid was prepared in the same way as Comparative Example 2 except that the xylene as an organic solvent was used in an amount of 30 parts and the water in an amount of 70 parts. The stability of the emulsion type charge transporting layer coating fluid obtained was evaluated in the same way as Comparative Example 1. The results are shown in Table 2.

TABLE 1

| Liquid Dispersion | Charge transporting | | | Liquid stability evaluation | |
|---|---|---|---|---|---|
| Preparation Example: | material | Binder resin | Aqueous dispersion medium | After leaving | After stirring |
| 1 | (1-1) | (2-1) | Water/methanol = 5/5 | Settled. | Not agglomerated. |
| 2 | (1-1) | (2-1) | Water/methanol = 6/4 | Settled. | Not agglomerated. |
| 3 | (1-1) | (2-1) | Water/methanol = 7/3 | Settled. | Not agglomerated. |
| 4 | (1-1) | (2-1) | Water/methanol = 3/7 | Partly settled. | Not agglomerated. |
| 5 | (1-1) | (2-1) | Water | Settled. | Not agglomerated. |
| 6 | (1-1) | (2-1) | Water/ethanol = 5/5 | Settled. | Not agglomerated. |
| 7 | (1-1) | (2-1) | Water/ethanol = 6/4 | Settled. | Not agglomerated. |
| 8 | (1-1) | (2-1) | Water/ethanol = 7/3 | Settled. | Not agglomerated. |
| 9 | (1-1) | (2-1) | Water/ethanol = 3/7 | Partly settled. | Not agglomerated. |
| 10 | (1-1) | (2-1) | Water | Settled. | Not agglomerated. |
| 11 | (1-1) | (2-1) | Water/methanol/DMM = 3/3/4 | Partly settled. | Not agglomerated. |
| 12 | (1-1) | (2-1) | Water/methanol/THF = 5/4/1 | Partly settled. | Not agglomerated. |
| 13 | (1-1) | (2-1) | Water/ethanol/o-xylene = 5/4/1 | Settled. | Not agglomerated. |
| 14 | (1-1) | (2-1) | Water/ethanol/DMM = 3/3/4 | Partly settled. | Not agglomerated. |
| 15 | (1-1) | (2-1) | Water/ethanol/THF = 5/4/1 | Partly settled. | Not agglomerated. |
| 16 | (1-1) | (2-1) | Water/ethanol/o-xylene = 5/4/1 | Settled. | Not agglomerated. |
| 17 | (1-2) | (2-2)/(2-3) = 5/5 | Water/methanol = 5/5 | Settled. | Not agglomerated. |
| 18 | (1-2) | (2-2)/(2-3) = 5/5 | Water/methanol = 6/4 | Settled. | Not agglomerated. |
| 19 | (1-2) | (2-2)/(2-3) = 5/5 | Water/methanol = 7/3 | Settled. | Not agglomerated. |
| 20 | (1-2) | (2-2)/(2-3) = 5/5 | Water/ethanol = 5/5 | Settled. | Not agglomerated. |
| 21 | (1-2) | (2-2)/(2-3) = 5/5 | Water/ethanol = 6/4 | Settled. | Not agglomerated. |
| 22 | (1-2) | (2-2)/(2-3) = 5/5 | Water/ethanol = 7/3 | Partly settled. | Not agglomerated. |
| 23 | (1-3) | (2-3)/(2-4) = 7/3 | Water/dimethoxymethane = 6/4 | Partly settled. | Not agglomerated. |
| 24 | (1-3) | (2-3)/(2-4) = 7/3 | Water/methanol/THF = 5/4/1 | Partly settled. | Not agglomerated. |
| 25 | (1-3) | (2-3)/(2-4) = 7/3 | Water/methanol/o-xylene = 5/4/1 | Settled. | Not agglomerated. |
| 26 | (1-4) | (2-3)/(2-6) = 7/3 | Water/dimethoxymethane = 6/4 | Partly settled. | Not agglomerated. |
| 27 | (1-4) | (2-3)/(2-6) = 7/3 | Water/ethanol/THF = 5/4/1 | Partly settled. | Not agglomerated. |
| 28 | (1-4) | (2-3)/(2-6) = 7/3 | Water/ethanol/o-xylene = 5/4/1 | Settled. | Not agglomerated. |
| 29 | (1-1)/(1-5) = 7/3 | (2-1) | Water/methanol = 5/5 | Settled. | Not agglomerated. |
| 30 | (1-1)/(1-5) = 7/3 | (2-1) | Water/methanol = 6/4 | Settled. | Not agglomerated. |
| 31 | (1-1)/(1-5) = 7/3 | (2-1) | Water/methanol = 7/3 | Settled. | Not agglomerated. |
| 32 | (1-1)/(1-5) = 7/3 | (2-1) | Water/ethanol = 5/5 | Settled. | Not agglomerated. |
| 33 | (1-1)/(1-5) = 7/3 | (2-1) | Water/ethanol = 6/4 | Settled. | Not agglomerated. |
| 34 | (1-1)/(1-5) = 7/3 | (2-1) | Water/ethanol = 7/3 | Settled. | Not agglomerated. |
| 35 | (1-1)/(1-5) = 7/3 | (2-1) | Water/dimethoxymethane = 6/4 | Settled. | Not agglomerated. |
| 36 | (1-1)/(1-5) = 7/3 | (2-1) | Water/ethanol/DMM = 3/3/4 | Partly settled. | Not agglomerated. |
| 37 | (1-5) | (3-1)/(3-2) = 5/5 | Water/methanol = 5/5 | Settled. | Not agglomerated. |
| 38 | (1-5) | (3-1)/(3-2) = 5/5 | Water/methanol = 6/4 | Settled. | Not agglomerated. |
| 39 | (1-5) | (3-1)/(3-2) = 5/5 | Water/methanol = 7/3 | Settled. | Not agglomerated. |
| 40 | (1-1)/(1-5) = 9/1 | (3-1)/(3-2) = 5/5 | Water/ethanol = 5/5 | Settled. | Not agglomerated. |
| 41 | (1-1)/(1-5) = 9/1 | (3-1)/(3-2) = 5/5 | Water/ethanol = 6/4 | Settled. | Not agglomerated. |
| 42 | (1-1)/(1-5) = 9/1 | (3-1)/(3-2) = 5/5 | Water/ethanol = 7/3 | Settled. | Not agglomerated. |
| 43 | (1-1)/(1-5) = 9/1 | (3-1)/(3-2) = 5/5 | Water/dimethoxymethane = 6/4 | Partly settled. | Not agglomerated. |
| 44 | (1-1)/(1-5) = 9/1 | (3-1)/(3-2) = 5/5 | Water/ethanol/DMM = 3/3/4 | Partly settled. | Not agglomerated. |
| 45 | (1-5) | (3-6) | Water/methanol = 5/5 | Settled. | Not agglomerated. |
| 46 | (1-5) | (3-6) | Water/methanol = 6/4 | Settled. | Not agglomerated. |
| 47 | (1-1)/(1-5) = 9/1 | (3-6) | Water/ethanol = 5/5 | Settled. | Not agglomerated. |
| 48 | (1-1)/(1-5) = 9/1 | (3-6) | Water/ethanol = 6/4 | Settled. | Not agglomerated. |
| 49 | (1-1)/(1-5) = 9/1 | (3-6) | Water/dimethoxymethane = 6/4 | Partly settled. | Not agglomerated. |

TABLE 1-continued

| Liquid Dispersion Preparation Example: | Charge transporting material | Binder resin | Aqueous dispersion medium | Liquid stability evaluation After leaving | Liquid stability evaluation After stirring |
|---|---|---|---|---|---|
| 50 | | (1-1)/(2-1) = 5/5 | Water/methanol = 5/5 | Settled. | Not agglomerated. |
| 51 | | (1-1)/(2-1) = 5/5 | Water/methanol = 6/4 | Settled. | Not agglomerated. |
| 52 | | (1-1)/(2-1) = 5/5 | Water/ethanol = 6/4 | Settled. | Not agglomerated. |
| 53 | | (1-1)/(2-1) = 5/5 | Water/dimethoxymethane = 6/4 | Partly settled. | Not agglomerated. |
| 54 | | (1-1)/(1-5)/(2-1) = 7/3/10 | Water/methanol = 5/5 | Settled. | Not agglomerated. |
| 55 | | (1-1)/(1-5)/(2-1) = 7/3/10 | Water/methanol = 6/4 | Settled. | Not agglomerated. |
| 56 | | (1-1)/(1-5)/(2-1) = 7/3/10 | Water/ethanol = 6/4 | Settled. | Not agglomerated. |
| 57 | | (1-1)/(1-5)/(2-1) = 7/3/10 | Water/dimethoxymethane = 6/4 | Partly settled. | Not agglomerated. |
| 58 | | (1-1)/(1-5)/(3-1)/(3-2) = 9/1/5/5 | Water/methanol = 5/5 | Settled. | Not agglomerated. |
| 59 | | (1-1)/(1-5)/(3-1)/(3-2) = 9/1/5/5 | Water/methanol = 6/4 | Settled. | Not agglomerated. |
| 60 | | (1-1)/(1-5)/(3-1)/(3-2) = 9/1/5/5 | Water/ethanol = 6/4 | Settled. | Not agglomerated. |
| 61 | | (1-1)/(1-5)/(3-1)/(3-2) = 9/1/5/5 | Water/dimethoxymethane = 6/4 | Partly settled. | Not agglomerated. |
| 62 | (1-1) | (2-1) | Water/methanol = 5/5 | Very partly settled. | Not agglomerated. |
| 63 | (1-1) | (2-1) | Water/methanol = 5/5 | Very partly settled. | Not agglomerated. |

DMM: dimethoxymethane;
THF: tetrahydrofuran

TABLE 2

| Comparative Example: | Charge transporting material | Binder resin | Emulsion coating fluid | Liquid stability evaluation After leaving | Liquid stability evaluation After stirring |
|---|---|---|---|---|---|
| 1 | (1-5) | (2-1) | Water/toluene = 5/4 | Settled and coalesced. | Agglomerated. |
| 2 | (1-3) | (2-1) | Water/xylene = 5/4 | Settled and coalesced. | Agglomerated. |
| 3 | (1-5) | (2-1) | Water/toluene = 6/3 | Settled and coalesced. | Agglomerated. |
| 4 | (1-3) | (2-1) | Water/xylene = 6/3 | Settled and coalesced. | Agglomerated. |
| 5 | (1-5) | (2-1) | Water/toluene = 7/2 | Settled and coalesced. | Agglomerated. |
| 6 | (1-3) | (2-1) | Water/xylene = 7/2 | Settled and coalesced. | Agglomerated. |

As is seen from comparison between Liquid Dispersion Preparation Examples and Comparative Examples, in the production process of the present invention in which the particles containing the charge transporting material and the particles containing the binder resin are dispersed in the aqueous dispersion medium to prepare the liquid dispersion, the liquid dispersion stably maintains the state of dispersion even in a condition of long-term storage, keeping its initial state alike. However, in the emulsion type charge transporting layer coating fluid disclosed in Japanese Patent Application Laid-open No. 2011-128213, although the oil droplets containing the charge transporting material and the binder resin may, in virtue of the addition of the surface-active agent, be stable immediately after it has been prepared, the oil droplets coalesce with one another after it has been stored for a long term to cause agglomeration.

In order to prepare the emulsion type coating fluid, the charge transporting material and the binder resin must be first dissolved in an organic solvent (halogenous solvent or aromatic solvent) having a high solubility to these. In order to keep such a coating fluid from coalescing from the state of an emulsion, it is preferable that the content of an organic solvent having a low affinity for water is made small. However, in an attempt to make small the content of such an organic solvent, the charge transporting material and the binder resin may have too high a concentration in the organic solvent to bring about a state of making it difficult to form the emulsion. Also, a method may be contemplated in which the content of the surface-active agent is made larger, but this is not a preferable method because surface-active agents commonly tend to come to make electrophotographic photosensitive members have poor performance.

In the production process in which the particles containing the charge transporting material and the particles containing the binder resin are dispersed in the aqueous dispersion medium to prepare the liquid dispersion, the solution containing the charge transporting material and the solution containing binder resin are converted into particles so as to prevent the particles from coalescing, and this makes the liquid dispersion improved in its stability. Employment of such a method enables the particles to be kept from coalescing because the content of the organic solvent (halogenous solvent or aromatic solvent) having a high solubility to the charge transporting material and binder resin can be made smaller in the liquid dispersion for charge transporting layer.

Likewise, in the production process of the present invention in which the particles containing both the charge transporting material and the binder resin are dispersed in the aqueous dispersion medium to prepare the liquid dispersion, the liquid dispersion stably maintains the state of dispersion even in a condition of long-term storage, keeping its initial state alike. In the production process of the present invention in which the particles containing both the charge transporting material and the binder resin are dispersed in the aqueous dispersion medium to prepare the liquid dispersion, the solution containing both the charge transporting material and the binder resin is converted into particles so as to prevent the particles from coalescing, and this makes the liquid dispersion improved in its stability. Employment of such a method enables the particles to be kept from coalescing because the content of the organic solvent (halogenous solvent or aromatic solvent) having a high solubility to the charge transporting material and binder resin can be made smaller in the liquid dispersion for charge transporting layer.

Electrophotographic photosensitive members each having the support, the conductive layer, the intermediate layer, the charge generation layer and the charge transporting layer were produced as described in the following Examples. Binder resins used in the following Examples 1 to 64 are soluble in molten products of the charge transporting materials in individual Examples at the temperature at which coats of the liquid dispersions are heated.

Example 1

An aluminum cylinder of 24 mm in outer diameter and 257 mm in length was used as the support.

Then, a conductive layer coating fluid was prepared with use of 10 parts of $SnO_2$-coated barium sulfate particles (conductive particles), 2 parts of titanium oxide (a resistance controlling pigment), 6 parts of phenol resin (a binder resin), 0.001 part of silicone oil (a leveling agent) and a mixed solvent of 4 parts of methanol and 16 parts of methoxypropanol. This conductive layer coating fluid was dip-coated on the support, followed by heating at 140° C. for 30 minutes to form a conductive layer with a layer thickness of 15 μm.

Next, 3 parts of N-methoxymethylated nylon and 3 parts of copolymer nylon were dissolved in a mixed solvent of 65 parts of methanol and 30 parts of n-butanol to prepare an intermediate layer coating fluid. This intermediate layer coating fluid was dip-coated on the conductive layer, followed by drying at 100° C. for 10 minutes to form an intermediate layer with a layer thickness of 0.7 μm.

Next, 10 parts of hydroxygallium phthalocyanine with a crystal form having strong peaks at Bragg angles of 2θ±0.2° of 7.5°, 9.9°, 16.3°, 18.6°, 25.1°, and 28.3° in CuKα characteristics X-ray diffraction was added to a solution prepared by dissolving 5 parts of polyvinyl butyral resin (trade name: S-LEC BX-1, available from Sekisui Chemical Co., Ltd.) in 250 parts of cyclohexanone. The mixture obtained was put to dispersion for 1 hour in an atmosphere of 23±3° C. by means of a sand mill making use of glass beads of 1 mm in diameter. After the dispersion, 250 parts of ethyl acetate was added to prepare a charge generation layer coating fluid.

This charge generation layer coating fluid was dip-coated on the intermediate layer, followed by drying at 100° C. for 10 minutes to form a charge generation layer with a layer thickness of 0.26 μm.

Next, as a charge transporting layer coating fluid, the liquid dispersion prepared in Liquid Dispersion Preparation Example 1 was dip-coated on the charge generation layer. The coat formed was heated at 150° C. for 1 hour to form the charge transporting layer, whereby the charge transporting material came molten and the binder resin came dissolved in a molten product of the charge transporting material, thus a charge transporting layer with a layer thickness of 15 μm was formed to produce an electrophotographic photosensitive member the charge transporting layer of which was a surface layer coat. The liquid dispersion used and the conditions for heating the coat formed by coating the liquid dispersion are shown in Table 3.

Evaluation was made as described next.

Evaluation of Coat Surface Uniformity:

The coat surface of the electrophotographic photosensitive member obtained was measured at its position of 120 mm from the upper end by using a surface profile analyzer (SURFCORDER SE3400, manufactured by Kosaka Laboratory Ltd.), to make evaluation according to the ten-point average roughness (Rzjis) evaluation prescribed in JIS B-0601:2001 (evaluation length: 10 mm). The results are also shown in Table 3.

Image Evaluation:

The electrophotographic photosensitive member obtained was used in a laser beam printer LBP-2510, manufactured by CANON INC., to make image evaluation. In the evaluation, about the exposure (imagewise exposure) of its 780 nm laser light source, the printer was so converted as to be 0.3 $\mu J/cm^2$ in amount of light on the surface of the electrophotographic photosensitive member, and used. Also, the evaluation was made in an environment of temperature 23° C. and humidity 15%. As the image evaluation, monochrome halftone images were reproduced on A4-size sheets of plain paper, and images reproduced were visually observed to make evaluation according to criteria shown below.

Rank A: Images are uniform over the whole area.

Rank B: Slight image non-uniformity is very partly seen.

Rank C: Image non-uniformity is seen.

Rank D: Conspicuous image non-uniformity is seen.

The results are shown in Table 3.

Examples 2 to 64

Electrophotographic photosensitive members were produced in the same way as Example 1 except that charge transporting layers were formed with use of the liquid dispersions listed in Table 3 and that the conditions for heating the coats formed by coating the liquid dispersions were set or changed as shown in Table 3. Evaluation was also made in the same way as Example 1. The results are shown in Table 3.

Comparative Examples 7 to 14

Electrophotographic photosensitive members were produced in the same way as Example 1 except that charge transporting layers were formed with use of the emulsion type coating fluids listed in Table 4 which were prepared according to the process disclosed in Japanese Patent Application Laid-open No. 2011-128213 and that the conditions for heating the coats formed by coating the emulsion type coating fluids were changed as shown in Table 4. Evaluation was also made in the same way as Example 1. Image non-uniformity corresponding to gentle unevenness formed on the surface of each electrophotographic photosensitive member was seen to have occurred. The results are shown in Table 4.

Comparative Examples 15 to 18

Electrophotographic photosensitive members were produced in the same way as Example 1 except that charge transporting layers were formed with use of the coating fluids prepared in Liquid Dispersion Preparation Examples listed in Table 4 and that the conditions for heating the coats formed by coating the liquid dispersions were changed as shown in Table 4. Evaluation was also made in the same way as Example 1. Image non-uniformity corresponding to gentle unevenness formed on the surface of each electrophotographic photosensitive member was seen to have occurred. The results are shown in Table 4.

Reference Example 1

The coat formed was heated at 150° C. for 1 hour in the same way as Example 1 except that the charge transporting material (1-1) in the liquid dispersion of Liquid Dispersion Preparation Example 1, used in Example 1, was not incorporated. The particles of the binder resin were present on the charge generation layer as they were, without melting and dissolving, and it was unable to form any uniform charge transporting layer.

Reference Example 2

The coat formed was heated at 150° C. for 1 hour in the same way as Example 1 except that the charge transporting materials (1-1) and (1-5) in the liquid dispersion of Liquid Dispersion Preparation Example 40, used in Example 40, were not incorporated. The particles of the binder resin were present on the charge generation layer as they were, without melting and dissolving, and it was unable to form any uniform charge transporting layer.

TABLE 3

| Example: | Liquid dispersion Liquid Dispersion Preparation Example No. | Heating conditions Heating temp. (° C.) | Heating time [hour(s)] | Uniformity evaluation (μm) | Image evaluation |
|---|---|---|---|---|---|
| 1 | 1 | 150 | 1 | 0.53 | A |
| 2 | 2 | 150 | 1 | 0.54 | A |
| 3 | 3 | 150 | 1 | 0.56 | A |
| 4 | 4 | 150 | 1 | 0.59 | A |
| 5 | 5 | 150 | 1 | 0.60 | A |
| 6 | 6 | 160 | 1 | 0.46 | A |
| 7 | 7 | 160 | 1 | 0.47 | A |
| 8 | 8 | 160 | 1 | 0.49 | A |
| 9 | 9 | 160 | 1 | 0.51 | A |
| 10 | 10 | 160 | 1 | 0.52 | A |
| 11 | 11 | 155 | 1 | 0.46 | A |
| 12 | 12 | 150 | 1 | 0.49 | A |
| 13 | 13 | 150 | 1 | 0.53 | A |
| 14 | 14 | 155 | 1 | 0.50 | A |
| 15 | 15 | 150 | 1 | 0.53 | A |
| 16 | 16 | 150 | 1 | 0.58 | A |
| 17 | 17 | 120 | 1 | 0.54 | A |
| 18 | 18 | 120 | 1 | 0.55 | A |
| 19 | 19 | 120 | 1 | 0.57 | A |
| 20 | 20 | 120 | 1 | 0.55 | A |
| 21 | 21 | 120 | 1 | 0.57 | A |
| 22 | 22 | 120 | 1 | 0.59 | A |
| 23 | 23 | 120 | 0.75 | 0.47 | A |
| 24 | 24 | 120 | 0.75 | 0.48 | A |
| 25 | 25 | 120 | 0.75 | 0.48 | A |
| 26 | 26 | 120 | 1 | 0.63 | B |
| 27 | 26 | 130 | 1 | 0.53 | A |
| 28 | 27 | 130 | 1 | 0.51 | A |
| 29 | 28 | 130 | 1 | 0.55 | A |
| 30 | 29 | 150 | 2 | 0.53 | A |
| 31 | 30 | 150 | 2 | 0.54 | A |
| 32 | 31 | 150 | 2 | 0.56 | A |
| 33 | 32 | 150 | 2 | 0.53 | A |
| 34 | 33 | 150 | 2 | 0.55 | A |
| 35 | 34 | 150 | 2 | 0.56 | A |
| 36 | 35 | 150 | 2 | 0.58 | A |
| 37 | 36 | 150 | 2 | 0.59 | A |
| 38 | 37 | 180 | 1 | 0.58 | A |
| 39 | 38 | 180 | 1 | 0.59 | A |
| 40 | 39 | 180 | 1 | 0.60 | A |
| 41 | 40 | 155 | 1 | 0.48 | A |
| 42 | 41 | 155 | 1 | 0.49 | A |
| 43 | 42 | 155 | 1 | 0.50 | A |
| 44 | 43 | 155 | 1 | 0.49 | A |
| 45 | 44 | 155 | 1 | 0.50 | A |
| 46 | 45 | 180 | 1 | 0.58 | A |
| 47 | 46 | 180 | 1 | 0.59 | A |
| 48 | 47 | 155 | 1 | 0.48 | A |
| 49 | 48 | 155 | 1 | 0.49 | A |
| 50 | 49 | 155 | 1 | 0.51 | A |
| 51 | 50 | 180 | 1 | 0.57 | A |
| 52 | 51 | 180 | 1 | 0.57 | A |
| 53 | 52 | 180 | 1 | 0.59 | A |

TABLE 3-continued

| Example: | Liquid dispersion Liquid Dispersion Preparation Example No. | Heating conditions Heating temp. (° C.) | Heating time [hour(s)] | Uniformity evaluation (μm) | Image evaluation |
|---|---|---|---|---|---|
| 54 | 53 | 180 | 1 | 0.58 | A |
| 55 | 54 | 155 | 1 | 0.48 | A |
| 56 | 55 | 155 | 1 | 0.48 | A |
| 57 | 56 | 155 | 1 | 0.49 | A |
| 58 | 57 | 155 | 1 | 0.47 | A |
| 59 | 58 | 155 | 1 | 0.47 | A |
| 60 | 59 | 155 | 1 | 0.49 | A |
| 61 | 60 | 155 | 1 | 0.48 | A |
| 62 | 61 | 155 | 1 | 0.47 | A |
| 63 | 62 | 155 | 1 | 0.53 | A |
| 64 | 63 | 155 | 1 | 0.54 | A |

TABLE 4

| Comparative Example: | Liquid dispersion | Heating conditions Heating temp. (° C.) | Heating time [hour(s)] | Uniformity evaluation (μm) | Image evaluation |
|---|---|---|---|---|---|
| 7 | Cp. 1 | 120 | 1 | 0.92 | D |
| 8 | Cp. 1 | 180 | 1 | 0.73 | C |
| 9 | Cp. 2 | 120 | 1 | 0.74 | D |
| 10 | Cp. 3 | 120 | 1 | 0.89 | D |
| 11 | Cp. 3 | 180 | 1 | 0.71 | C |
| 12 | Cp. 4 | 120 | 1 | 0.75 | D |
| 13 | Cp. 5 | 120 | 1 | 0.88 | D |
| 14 | Cp. 6 | 120 | 1 | 0.75 | D |
| 15 | LDPE 13 | 140 | 1 | 0.73 | C |
| 16 | LDPE 37 | 160 | 1 | 0.79 | C |
| 17 | LDPE 45 | 160 | 1 | 0.81 | C |
| 18 | LDPE 50 | 160 | 1 | 0.79 | C |

Cp.: Comparative Ex.;
LDPE.: Liquid Dispersion Preparation Example

As is seen from comparison between the Examples and Comparative Examples 7 to 14, the emulsion type coating fluid disclosed in Japanese Patent Application Laid-open No. 2011-128213 has brought a result of an inferior coat surface uniformity. This is because the oil droplets have come to agglomerated because of the coalescence of oil droplets after the emulsion type coating fluid has been stored for a long term, to damage the uniformity of the oil droplets in the emulsion type coating fluid, and this has brought a poor uniformity of coat surface of the coat having been formed, as so considered. Also, even where the temperature at which the coat is heated is made higher, though an improvement in coat surface uniformity is seen, any sufficient coat surface uniformity is not brought to have been achieved.

On the other hand, in the production process of the present invention in which the particles containing the charge transporting material and the particles containing the binder resin are dispersed in the aqueous dispersion medium to prepare the liquid dispersion, the liquid dispersion has brought a result of a high coat surface uniformity. This is considered due to the fact that the particles do not come to agglomerate in the liquid dispersion and the liquid dispersion exists stably even after the liquid dispersion has been stored for a long term.

Likewise, in the production process of the present invention in which the particles containing both the charge transporting material and the binder resin are dispersed in the aqueous dispersion medium to prepare the liquid dispersion, the liquid dispersion has brought a result of a high coat surface uniformity. This is considered due to the fact that the particles do not come to agglomerate in the liquid dispersion and the liquid dispersion exists stably even after the liquid dispersion has been stored for a long term.

As is seen from comparison between Examples and Comparative Examples 15 to 18, the liquid dispersion has brought a result that a charge transporting layer having a high coat surface uniformity can be formed in the case when the temperature at which the coat formed upon the coating of the liquid dispersion is heated is temperature not less than the melting point of a charge transporting material having the lowest melting point among charge transporting materials constituting the charge transporting layer. This is because a phenomenon has taken place in which the charge transporting material melts upon the heating at a temperature higher than the melting point of the charge transporting material contained in the particles and the binder resin dissolves in a molten product of the charge transporting material.

This phenomenon not only enables improvement of the joining of the particles with one another, but also makes the boundary surfaces between the particles vanish as a result of their dissolution to make the coat surface uniformity higher, as so considered. It is further proved that, the heating at a temperature higher by 5° C. or more, than the melting point of the charge transporting material having the lowest melting point among charge transporting materials constituting the charge transporting layer, enables the coat with a high uniformity to be formed in a short time.

Liquid Dispersion Preparation Example 64

A liquid dispersion comprised of particles containing a charge transporting material and particles containing a binder resin was prepared in the following way.

As a charge transporting material the compound represented by the formula (1-1) was ground by means of Mixer Mill. Conditions for the grinding were so controlled that the resultant particles containing the charge transporting material might have particle diameters of 4 to 15 μm. Likewise, as a binder resin the polycarbonate resin having a repeating structural unit represented by the formula (2-1) (weight average molecular weight Mw: 80,000) was ground by means of Mixer Mill. Conditions for the grinding were so controlled that the resultant particles containing the binder resin might have particle diameters of 5 to 15 μm.

Next, 10 parts of the particles containing the charge transporting material and 10 parts of the particles containing the binder resin were added to 40 parts of water, and these were put to dispersion by means of a high-pressure dispersion machine Microfluidizer and under such conditions that the particles could be dispersed to have their primary particle diameter. After the dispersion was completed, 40 parts of methanol was added to obtain a liquid dispersion. The stability of the liquid dispersion obtained was evaluated in the same way as Liquid Dispersion Preparation Example 1. The results are shown in Table 5.

Liquid Dispersion Preparation Examples 65 to 69

Liquid Dispersions were obtained in the same way as Liquid Dispersion Preparation Example 64, but under conditions changed as shown in Table 5. These liquid dispersions were evaluated in the same way as Liquid Dispersion Preparation Example 1. Evaluation results on the stability of the liquid dispersions obtained are also shown in Table 5.

Liquid Dispersion Preparation Example 70

A liquid dispersion comprised of particles containing both a charge transporting material and a binder resin was prepared in the following way.

As a charge transporting material 20 parts of the compound represented by the formula (1-1) (melting point: 145° C.) and as a binder resin 20 parts of the polycarbonate resin having a repeating structural unit represented by the formula (2-1) (weight average molecular weight Mw: 80,000) were dissolved in 960 parts of o-xylene. The solution obtained was applied onto a flat plate and the coat formed was dried to produce a film containing both the charge transporting material and the binder resin. The film obtained was ground by means of Mixer Mill to produce particles containing both the charge transporting material and the binder resin.

Next, 20 parts of the particles containing both the charge transporting material and the binder resin were added to 40 parts of water, and these were put to dispersion by means of a high-pressure dispersion machine Microfluidizer. After the dispersion was completed, 40 parts of methanol was added to obtain a liquid dispersion. The stability of the liquid dispersion obtained was evaluated in the same way as Liquid Dispersion Preparation Example 1. The results are shown in Table 5.

Liquid Dispersion Preparation Examples 71 to 74

Liquid Dispersions were obtained in the same way as Liquid Dispersion Preparation Example 70, but under conditions changed as shown in Table 5. These liquid dispersions were evaluated in the same way as Liquid Dispersion Preparation Example 1. Evaluation results on the stability of the liquid dispersions obtained are also shown in Table 5.

Examples 65 to 75

Electrophotographic photosensitive members were produced in the same way as Example 1 except that the charge transporting layers were formed with use of the liquid dispersions listed in Table 6 and that the coats formed by coating the liquid dispersions were heated under conditions as shown in Table 6. Evaluation was also made on the coat surface uniformity in the same way as Example 1. The results are shown in Table 6.

TABLE 5

| Liquid Dispersion Preparation Example: | Charge transporting material | Binder resin | Aqueous dispersion medium | Liquid stability evaluation After leaving | Liquid stability evaluation After stirring |
|---|---|---|---|---|---|
| 64 | (1-1) | (2-1) | Water/methanol = 5/5 | Settled. | Not agglomerated. |
| 65 | (1-2) | (2-2)/(2-3) = 5/5 | Water/methanol = 4/6 | Settled. | Not agglomerated. |
| 66 | (1-1)/(1-5) = 7/3 | (2-1) | Water/methanol = 6/4 | Settled. | Not agglomerated. |
| 67 | (1-1)/(1-5) = 9/1 | (3-2)/(3-2) = 5/5 | Water/ethanol = 5/5 | Settled. | Not agglomerated. |
| 68 | (1-5) | (3-6) | Water/methanol = 6/4 | Settled. | Not agglomerated. |

TABLE 5-continued

| Liquid Dispersion Preparation Example: | Charge transporting material | Binder resin | Aqueous dispersion medium | Liquid stability evaluation After leaving | After stirring |
|---|---|---|---|---|---|
| 69 | (1-1)/(1-5) = 9/1 | (3-6) | Water/ethanol = 5/5 | Settled. | Not agglomerated. |
| 70 | (1-1)/(2-1) = 5/5 | | Water/methanol = 5/5 | Settled. | Not agglomerated. |
| 71 | (1-1)/(2-1) = 5/5 | | Water/methanol = 6/4 | Settled. | Not agglomerated. |
| 72 | (1-1)/(1-5)/(3-1)/(3-2) = 9/1/5/5 | | Water/methanol = 5/5 | Settled. | Not agglomerated. |
| 73 | (1-1)/(1-5)/(3-1)/(3-2) = 9/1/5/5 | | Water/methanol = 6/4 | Settled. | Not agglomerated. |
| 74 | (1-1)/(1-5)/(3-1)/(3-2) = 9/1/5/5 | | Water/ethanol = 6/4 | Settled. | Not agglomerated. |

TABLE 6

| Example: | Liquid dispersion Liquid Dispersion Preparation Example No. | Heating conditions Heating temp. (° C.) | Heating time [hour(s)] | Uniformity evaluation (μm) |
|---|---|---|---|---|
| 65 | 64 | 150 | 1 | 0.55 |
| 66 | 65 | 120 | 1 | 0.57 |
| 67 | 66 | 150 | 2 | 0.58 |
| 68 | 67 | 155 | 1 | 0.52 |
| 69 | 68 | 180 | 1 | 0.60 |
| 70 | 69 | 155 | 1 | 0.51 |
| 71 | 70 | 180 | 1 | 0.61 |
| 72 | 71 | 180 | 1 | 0.55 |
| 73 | 72 | 155 | 1 | 0.48 |
| 74 | 73 | 155 | 1 | 0.50 |
| 75 | 74 | 155 | 1 | 0.50 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-282078, filed Dec. 22, 2011, and Japanese Patent Application No. 2012-270604, filed Dec. 11, 2012, which are hereby incorporated by reference herein in their entirety.

The invention claimed is:

1. A process for producing an electrophotographic photosensitive member which comprises a support and a charge transporting layer formed on the support, comprising the steps of:

preparing the following liquid dispersion (i) or (ii);

(i) a liquid dispersion comprising particles containing a charge transporting material, particles containing a binder resin, and an aqueous dispersion medium; or (ii) a liquid dispersion comprising particles containing both a charge transporting material and a binder resin, and an aqueous dispersion medium;

forming a coat of the liquid dispersion (i) or (ii) on the support; and heating the coat at a temperature not less than the melting point of the charge transporting material to form the charge transporting layer;

the binder resin being soluble in a molten product of the charge transporting material at the temperature at which the coat is heated.

2. The process for producing the electrophotographic photosensitive member according to claim 1, wherein the binder resin is at least one selected from the group consisting of a polycarbonate resin and a polyester resin.

3. The process for producing the electrophotographic photosensitive member according to claim 1, wherein the water in the aqueous dispersion medium is in a content of 30% by mass or more, based on the total mass of the aqueous dispersion medium.

4. The process for producing the electrophotographic photosensitive member according to claim 1, wherein the aqueous dispersion medium contains at least one selected from the group consisting of methanol and ethanol.

5. The process for producing the electrophotographic photosensitive member according to claim 4, wherein the total content of the content of the water and the content of at least one selected from the group consisting of methanol and ethanol in the aqueous dispersion medium is 60% by mass or more, based on the total mass of the aqueous dispersion medium.

6. The process for producing the electrophotographic photosensitive member according to claim 1, wherein the charge transporting material is at least one selected from the group consisting of a triarylamine compound and a hydrazone compound.

7. The process for producing the electrophotographic photosensitive member according to claim 1, wherein the charge transporting material and binder resin in the charge transporting layer are in a mass ratio of from 4:10 to 20:10.

8. The process for producing the electrophotographic photosensitive member according to claim 1, wherein the temperature at which the coat is heated is 200° C. or less.

9. The process for producing the electrophotographic photosensitive member according to claim 1, wherein, in the step of forming the charge transporting layer, the binder resin is dissolved in the molten product of the charge transporting material.

* * * * *